US007425922B1

(12) United States Patent
Adams

(10) Patent No.: US 7,425,922 B1
(45) Date of Patent: Sep. 16, 2008

(54) WEARABLE SMALL-SIZED PATCH ANTENNA FOR USE WITH A SATELLITE

(75) Inventor: Richard C. Adams, Chula Vista, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 248 days.

(21) Appl. No.: 11/639,582

(22) Filed: Dec. 15, 2006

(51) Int. Cl.
*H01Q 1/38* (2006.01)

(52) U.S. Cl. ..... 343/700 MS; 343/718

(58) Field of Classification Search ..... 343/700 MS, 343/702, 718, 829, 846
See application file for complete search history.

(56) References Cited

U.S. PATENT DOCUMENTS 5,769,879 A * 6/1998 Richards et al. ..... 607/101
6,157,344 A * 12/2000 Bateman et al. ..... 343/700 MS
6,208,903 B1 * 3/2001 Richards et al. ..... 607/101
6,249,254 B1 * 6/2001 Bateman et al. ..... 343/700 MS
6,888,503 B2 * 5/2005 Shikata ..... 343/700 MS
2005/0249667 A1 * 11/2005 Tuszynski et al. ..... 424/9.3

* cited by examiner

*Primary Examiner*—Tho G Phan
(74) *Attorney, Agent, or Firm*—Kyle Eppele; Arthur K. Samora; Peter A. Lipovsky

(57) ABSTRACT

A wearable patch antenna comprises a dielectric layer including water; a ground plane adjacent one side of the dielectric layer; a conductive patch element placed adjacent another side of the dielectric layer spaced from the ground plane by the dielectric layer; and a feed electrically connected to the conductive patch element.

13 Claims, 1 Drawing Sheet

WEARABLE SMALL-SIZED PATCH ANTENNA FOR USE WITH A SATELLITE

BACKGROUND

A known Ultra-High-Frequency (UHF) Satellite Communication (SATCOM) system consists of a constellation of approximately a half dozen satellites hovering over the equator. The downlink frequency of this system is between 243 MegaHertz (MHz) and 270 MHz. A subset of the UHF SATCOM system is the Fleet Broadcasting System whose one-way downlink operates in the 248 MHz to 255 MHz range. Radiations at these wavelengths are approximately 1 meter (m).

The antennas typically used for such wavelengths are quite large. The usual applicable shipboard antenna is in the form of a drum that is approximately 1.37 m in diameter. Another suitable shipboard antenna for such communication has crossed dipoles each of which has a length of approximately 0.5 m. The UHF SATCOM system and Fleet Broadcasting System are not known for sending messages directly to a person.

The hand-held satellite phones and global positioning systems (GPS) that are used directly by individuals are vulnerable to being easily jammed by strong signals radiated in the area of reception of the phone and GPS users. Patch antennas help mitigate these conditions. The high gain and narrow reception frequencies of the patch antenna can be used to advantage in such environments. Patch antenna gain of 6 to 8 dBi have been measured. Narrowband frequency applications of the patch antennas are made possible by the antenna's characteristic of resonating at wavelengths equal to twice the antenna's effective length To provide a patch antenna for personal use, for example one being suitable for placement directly upon (worn by) a user, the physical size of the patch antenna must be considered. Several factors contribute to this size. The resonant frequency of the patch antenna conducting element is inversely related to the dielectric constant of the dielectric material used in the over-all patch antenna design. Increasing this dielectric constant increases the effective length of the antenna thereby enabling a physically smaller antenna than one having a lesser dielectric constant. The size of the ground plane also plays a role, though lesser, in patch antenna operating characteristics. A patch antenna, being a resonant element, compels a relatively narrow operating bandwidth.

There is a need for a relatively small and wearable narrowband antenna that is usable with satellite communication frequencies.

SUMMARY

A wearable patch antenna comprises a dielectric layer including water; a ground plane adjacent one side of the dielectric layer; a conductive patch element placed adjacent another side of the dielectric layer spaced from the ground plane by the dielectric layer; and a feed electrically connected to the conductive patch element.

Other objects, advantages and new features of the invention will become apparent from the following detailed description of the invention when considered in conjunction with the accompanied drawings.

DESCRIPTION

Figure 1:
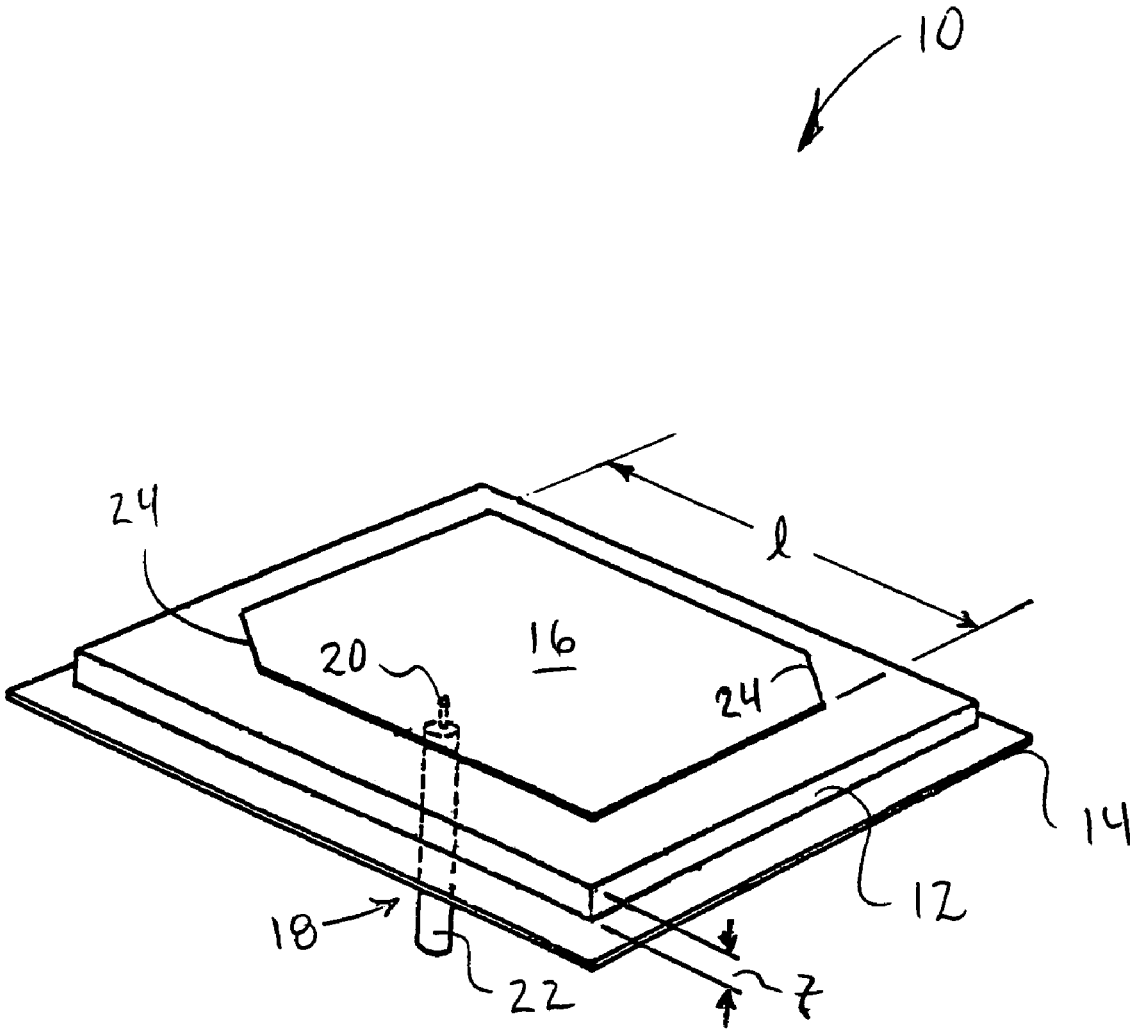
FIG. 1 is a perspective view of a representative patch antenna according to the description herein.

Referring to FIG. 1, a wearable patch antenna apparatus 10 according to the description herein is shown. Antenna apparatus 10 is shown having a dielectric layer 12 that includes contained water as will be further described. Operably coupled to one side of dielectric layer 12 is a ground plane 14 that acts as a ground layer for antenna apparatus 10. Ground plane 14 is a conductive layer such as a thin-layered metal, metal-alloy or metal-composite.

Operably disposed and placed adjacent to another side of dielectric layer 12 is a conductive patch element 16. Conductive patch element 16 is of a thin layer of conductive material such as a thin layer of a metal such as copper, silver, gold or aluminum, for example, and may also be a conductive alloy, conductive oxide layer or a conductive polymer or conductive polymer alloy.

Conductive patch element 16 and ground plane 14 are physically spaced apart by dielectric layer 12. As can be additionally seen, an antenna feed 18 has an inner conductive core 20 that is electrically connected to conductive patch element 16 and, in the example shown, has a co-axial outer shield layer 22 that is operably electrically coupled to ground plane 14.

Truncated corners 24 of conductive patch element are an option that are shown in this example to exemplify a patch element suitable for circular polarization capability. There are various techniques employed by those skilled in this art to achieve circular antenna polarization. Oppositely opposed truncated corners, as shown, is one of these techniques but this example is not described to communicate to the reader that other ways of accomplishing circular polarization do not exist. Circular polarization, in this case right-hand circular polarization, is efficient with satellite communication reception and transmissions, as those of skill in this art will know.

As previously mentioned, patch antenna apparatus 10 includes dielectric layer 12, in this instance, one that includes contained water. All dielectrics are characterized by a physical characteristic known as the dielectric constant. This dielectric constant is represented by the symbol $\in_r$. The value of a patch antenna dielectric constant is typically 1.4 to 2.5. Using dielectric material increases the effective length (resonant length) of the patch antenna by a factor equal to $\sqrt{\in_r}$.

As aforementioned, to enable a patch antenna to be easily wearable by a user who desires to receive frequencies of satellite communications, such as those described previously by way of example, the patch antenna should be small in physical size.

To accomplish this goal, it is desirable to utilize a dielectric material of high dielectric constant. The high dielectric constant dielectric material will accordingly result in a patch antenna that has a high effective length and thereby a small size.

The patch antenna apparatus described here uses water as a dielectric. For the frequency applications described herein, water has a dielectric constant of 81. Consequently, the effective length of the patch antenna is increased by a factor of nine.

The antenna apparatus described here uses water converted from a liquid state to a substantially solidified state by combing the liquefied water with a gelling/solidifying agent, such a petroleum-based or polymer-based substance. Commercial agents are available for this, for example, the commercial powder substance TX-151 of Oil Research, Inc. P.O. Box 51871, La Fayette, La. 70505. Based upon amount added this substance converts water from a liquid state to a gel and up to a solid wherein the dielectric properties of the water remain.

Upon the liquid water being substantially solidified, it can be operably placed or sandwiched between ground plane 14 and conductive patch 16 as is shown in FIG. 1. The solidified water can then be drilled so that feed 18 can be operably connected as described above.

A receive-only patch antenna apparatus with water as a dielectric designed to receive a signal of 255 MHz (a mid-band of the SATCOM downlink) can take the form of a truncated square having a length (shown in FIG. 1 as "l") of 6.5 centimeters. A suitable thickness, shown as "t" in FIG. 1 is about 1/10 of a millimeter (mm) though is a thickness of about 0.089 mm to 12.7 mm can be used. The dimensions of substantially square ground plane 14 as shown in FIG. 1 are about 1.25 times "l" for each side but can be increased where feasible.

In this description, there is disclosed a patch antenna apparatus that is relatively small, is of high gain, and that is highly selective of the frequencies admitted to the antenna apparatus (i.e. narrowband). The antenna apparatus will reject frequencies except those within a small band around the frequency at which it resonates. The antenna apparatus' inherent gain characteristic will allow its use with amplifiers of small size and will promote long-lived battery life. The antenna apparatus can be conveniently worn on a user's shoulder, for example, placing it away from other parts of a user's body where packs or protective wear or equipment are usually worn.

A patch antenna apparatus having a patch element of substantially square shape has been shown by way of example, however those of skill in this art will realize that other shapes of patch elements such as a circular patch element and even a two-dimensional patch element have applications.

Obviously, many modifications and variations of the invention are possible in light of the above description. It is therefore to be understood that within the scope of the appended claims, the invention may be practiced otherwise than as has been specifically described.

What is claimed is:

1. A patch antenna apparatus comprising:

a solid dielectric layer including contained water and a ceiling agent;

a ground plane placed adjacent one side of said dielectric layer;

a conductive patch element placed adjacent another side of said dielectric layer and spaced from said ground plane by said dielectric layer; and a feed electrically connected to said conductive patch element.

2. The apparatus of claim 1 wherein said conductive patch element resonates between about 240 MHz to 270 MHz.

3. The apparatus of claim 1 wherein said dielectric layer has a dielectric constant of about 81.

4. The apparatus of claim 1 wherein said conductive patch element has a resonant length of about 6.5 centimeters.

5. The apparatus of claim 1 wherein said conductive patch element is a corner truncated patch element having at least two opposing truncated corners.

6. The apparatus of claim 1 wherein said contained water is at least partially solidified.

7. A patch antenna apparatus comprising:

a dielectric layer including water and a solidifying agent, said water and solidifying agent combining to convert water from a liquid state to a substantially solidified state;

a ground plane placed adjacent one side of said dielectric layer;

a conductive patch element placed adjacent another side of said dielectric layer and spaced from said ground plane by said dielectric layer; and a feed electrically connected to said conductive patch element.

8. The apparatus of claim 7 wherein said conductive patch element resonates between about 240 MHz to 270 MHz.

9. The apparatus of claim 8 wherein said conductive patch element has a resonant length of about 6.5 centimeters.

10. The apparatus of claim 8 wherein said conductive patch element is a corner truncated patch element having at least two opposing truncated corners.

11. The apparatus of claim 7 wherein said dielectric layer has a dielectric constant of about 81.

12. The apparatus of claim 7 wherein said solidifying agent is a petroleum-based substance.

13. The apparatus of claim 7 wherein said solidifying agent is polymer-based substance.

* * * * *